US009780500B2

(12) United States Patent
Kao et al.

(10) Patent No.: US 9,780,500 B2
(45) Date of Patent: Oct. 3, 2017

(54) ELECTRICAL PLUG CONNECTOR

(71) Applicant: Advanced-Connectek Inc., New Taipei (TW)

(72) Inventors: Ya-Fen Kao, New Taipei (TW); Yu-Lun Tsai, New Taipei (TW); Pin-Yuan Hou, New Taipei (TW); Chung-Fu Liao, New Taipei (TW); Wen-Hsien Tsai, New Taipei (TW); Mao-Sheng Chen, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 14/817,376

(22) Filed: Aug. 4, 2015

(65) Prior Publication Data

US 2016/0043512 A1 Feb. 11, 2016

(30) Foreign Application Priority Data

Aug. 6, 2014 (TW) ..... 103126995 A

(51) Int. Cl.

| | |
|---|---|
| ***H01R 12/57*** | (2011.01) |
| ***H01R 13/66*** | (2006.01) |
| ***H01R 24/60*** | (2011.01) |
| ***H01R 43/16*** | (2006.01) |
| ***H01R 107/00*** | (2006.01) |

(52) U.S. Cl.

CPC ..... *H01R 13/6658* (2013.01); *H01R 12/57* (2013.01); *H01R 24/60* (2013.01); *H01R 43/16* (2013.01); *H01R 2107/00* (2013.01)

(58) Field of Classification Search

CPC .. H01R 12/57; H01R 13/665; H01R 13/6275; H01R 13/6585; H01R 13/6581; H01R 13/6658; H01R 24/60; H01R 43/16

See application file for complete search history.

(56) References Cited

U.S. PATENT DOCUMENTS 5,893,764 A * 4/1999 Long ..... H01R 12/7029 439/570

7,207,825 B2 * 4/2007 Le Gallic ..... H01R 13/6275 439/357

(Continued)

*Primary Examiner* — Amy Cohen Johnson
*Assistant Examiner* — Oscar C Jimenez
(74) *Attorney, Agent, or Firm* — Alan D. Kamrath; Kamrath IP Lawfirm, P.A.

(57) ABSTRACT

An electrical plug connector includes an insulated housing, a metallic shell, two terminal sets, and a circuit board. The insulated housing includes a front portion and a rear portion. The front portion extends forwardly from the rear portion, and an inside of the front portion forms a receiving cavity. The metallic shell covers the insulated housing. Each terminal set is composed with a plurality of terminals. Each terminal includes a contact portion, a retaining portion, and a soldering portion. The retaining portion is retained in the insulated housing. The soldering portion extends backwardly from the retaining portion. The soldering portions are arranged as an upper row and a lower row in symmetry, and the soldering portion is of the spring arm type. The circuit board is inserted between the upper row and the lower row of the soldering portions. The upper row and the lower row of the soldering portions clip elastically the circuit board.

11 Claims, 8 Drawing Sheets

(56) References Cited

U.S. PATENT DOCUMENTS

| | | | | |
|---|---|---|---|---|
| 7,232,345 | B2 * | 6/2007 | Ishizuka | H01R 13/6585 439/660 |
| 7,867,010 | B1 * | 1/2011 | Ting | H01R 13/6275 439/353 |
| 9,318,856 | B2 * | 4/2016 | MacDougall | H01R 13/6581 |
| 9,397,433 | B2 * | 7/2016 | Kao | H01R 13/658 |
| 9,502,837 | B2 * | 11/2016 | Kuramoto | H01R 24/60 |
| 9,515,436 | B2 * | 12/2016 | Kao | H01R 24/60 |
| 9,531,144 | B2 * | 12/2016 | Tsai | H01R 13/658 |
| 2015/0171561 | A1 * | 6/2015 | Little | H01R 24/60 439/607.34 |
| 2015/0194772 | A1 * | 7/2015 | Little | H01R 13/6597 439/357 |
| 2015/0270659 | A1 * | 9/2015 | Kao | H01R 24/64 439/607.01 |
| 2015/0340821 | A1 * | 11/2015 | Yen | H01R 24/62 439/607.01 |
| 2016/0013566 | A1 * | 1/2016 | Wu | H01R 4/023 439/676 |
| 2016/0268756 | A1 * | 9/2016 | Mermelstein | H01S 3/0672 |
| 2016/0322756 | A1 * | 11/2016 | Tsai | H01R 13/6581 |

* cited by examiner

ELECTRICAL PLUG CONNECTOR

BACKGROUND OF INVENTION

1. Field of the Invention

The present invention relates to an electrical connector and, more particularly, to an electrical plug connector.

2. Description of Prior Art

The conventional electrical plug connector includes an insulated housing, a plurality of terminals, and a circuit board. The front end of the insulated housing defines an opening and an insertion space therein. In other words, the insertion space which communicates with the opening is surrounded by the insulated housing. The terminals which are retained in the insulated housing are arranged in an upper row and a lower row. The front ends of the terminals are contact portions. The contact portions of the electrical plug connector are used to electrically contact with the plurality of terminals of the mating electrical receptacle connector. The contact portions are exposed in the insertion space and arranged in the upper row and the lower row, which are disposed in an upper inner surface and a lower inner surface of the insulated housing. The rear ends of the terminals are soldering portions. The soldering portions are used for being soldered on the circuit board. The soldering portions extend backwardly from the rear end of the insulated housing, and the soldering portions are arranged in the upper row and the lower row. In conventional technology, the soldering portions of the terminals are plate terminals, or, in other words, the upper-row soldering portions are parallel to the lower-row soldering portions. The upper-row soldering portions and the lower-row soldering portions do not have any bending portions. When manufacturing the conventional plug electrical connector, the circuit board is placed between the upper-row soldering portions and the lower-row soldering portions of the terminals in advance, and then the soldering portions are soldered onto the circuit board by the hot bar soldering process. Bending damage of the terminals occurs when the circuit board collides with the soldering portions due to the position tolerance of the terminals when the upper-row soldering portions and the lower-row soldering portions of the terminals are inserted between an upper surface and a lower surface of the circuit board.

SUMMARY OF THE INVENTION

In view of this, the present invention provides an electrical plug connector to avoid the circuit board colliding with the soldering portions resulting in the bending damage of the terminals due to the position tolerance of the terminals when the upper-row soldering portions and the lower-row soldering portions of the terminals are inserted between an upper surface and a lower surface of the circuit board.

To obtain the goal, the present invention provides an electrical plug connector, comprising: an insulated housing including a rear portion, a front portion extending forwardly from the rear portion, and a receiving cavity formed inside the front portion. The front portion includes an upper inner side, a left inner side, a lower inner side, and a right inner side which surround and form the receiving cavity, and the upper inner side and the lower inner side are formed respectively with a plurality of terminal slots. A metallic shell covers the insulated housing. Two terminal sets respectively include a plurality of terminals and are symmetrical about the center line of the receiving cavity as the symmetrical center. The terminal sets are respectively disposed on the upper inner side and the lower inner side, and each terminal includes a contact portion, a retaining portion, and a soldering portion. The retaining portions are retained in the insulated housing. The soldering portions extend backwardly from the retaining portions and are disposed at the rear portion, and the soldering portions are arranged as an upper row and a lower row in symmetry. Some parts of the contact portions are disposed in the terminal slots, while other parts of the contact portions project forward into the receiving cavity. A circuit board is inserted between the upper-row soldering portions, and the lower-row soldering portions and the upper-row soldering portions and the lower-row soldering portions clip elastically the circuit board.

In a preferred embodiment of the present invention, the soldering portion includes a bending portion and an end portion. The bending portion extends out the rear portion, and the end portion extends backwardly from the bending portion. The shortest distance between the upper-row bending portions and the lower-row bending portions is a first pitch D1. The shortest distance between the upper-row end portions and the lower-row end portions is a second pitch D2. The second pitch D2 is greater than the first pitch D1.

In a preferred embodiment of the present invention, the bending portions are soldered on the circuit board by SMT technology.

In a preferred embodiment of the present invention, the contact portions are of the spring arm type.

In a preferred embodiment of the present invention, the electrical plug connector further comprises two latches. Each latch includes a hook portion, a retaining portion, and a soldering portion. The retaining portions of the latches are separately retained in the insulated housing. The hook portions project into the receiving cavity and adjoin the left inner side and the right inner side. The soldering portions of the latches extend backwardly out the rear portion. The soldering portions of the latches are of a spring arm type and are soldered on the circuit board.

In a preferred embodiment of the present invention, the circuit board includes two wing portions. The wing portions are separately disposed on two sides of the circuit board. The insulated housing further includes two recessed slots, and the recessed slots are separately disposed on two sides of the rear portion. The metallic shell includes two gaps which are disposed separately respect to the recessed slots, and the wing portions are inserted between the recessed slots and the gaps and clip two sides of the rear portion.

In a preferred embodiment of the present invention, the a cross-section of the rear portion is greater than that of the front portion, and the front portion extends forwardly from a central portion of the rear portion. The metallic shell covers the front portion and the rear portion, and the rear end of the metallic shell and the rear portion are engaged with each other.

In a preferred embodiment of the present invention, the electrical plug connector further comprises a wire and an auxiliary metallic shell. The auxiliary metallic shell includes a wire clamp portion which is disposed in the rear end of the auxiliary metallic shell. The front end of the wire is soldered on the circuit board, and the auxiliary metallic shell surrounds the soldering portion and the circuit board. The wire clamp portion clamps the wire, and the front end of the auxiliary metallic shell is engaged in the rear end of the metallic shell.

In a preferred embodiment of the present invention, the electrical plug connector further comprises an overcoat which comprises a pipe portion which is disposed in the rear end of the overcoat and surrounds the auxiliary metallic shell, with the wire penetrating the pipe portion.

The electrical plug connector, provided by the present invention with the soldering portion of the spring arm type and with the elasticity provided by the soldering portion, makes the insertion of the circuit board between the upper-row soldering portions and the lower-row soldering portions convenient to avoid the situation of bending damage of the terminals due to the collision of the circuit board and the soldering portions.

DETAILED DESCRIPTION

To make the purpose, the features, and advantages of this invention to be easier to be understood to those who has the general knowledge in this field, a preferred embodiment is recited in detail below with the accompanying drawings.

Figure 1:
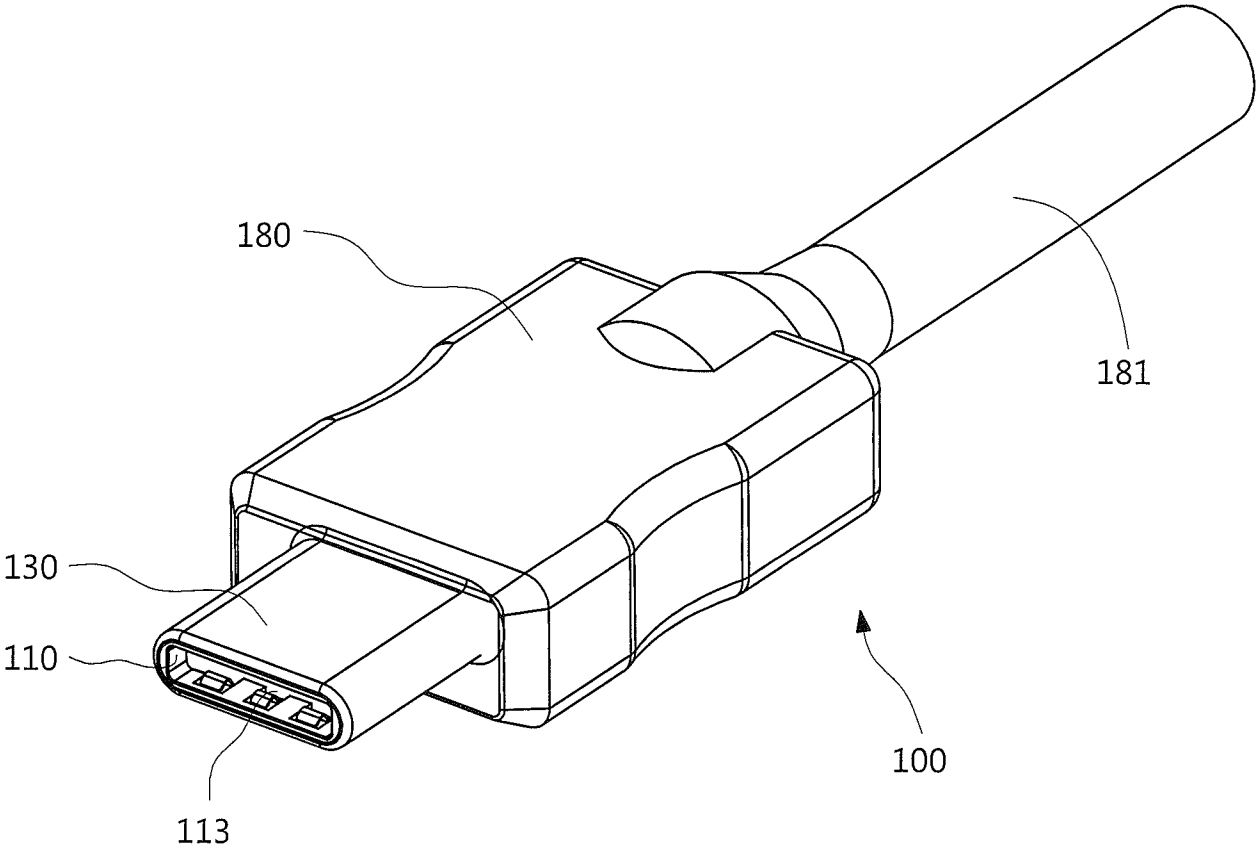
FIG. 1 is a schematic diagram of a preferred embodiment of the electrical plug connector according to the present invention.
Figure 2:
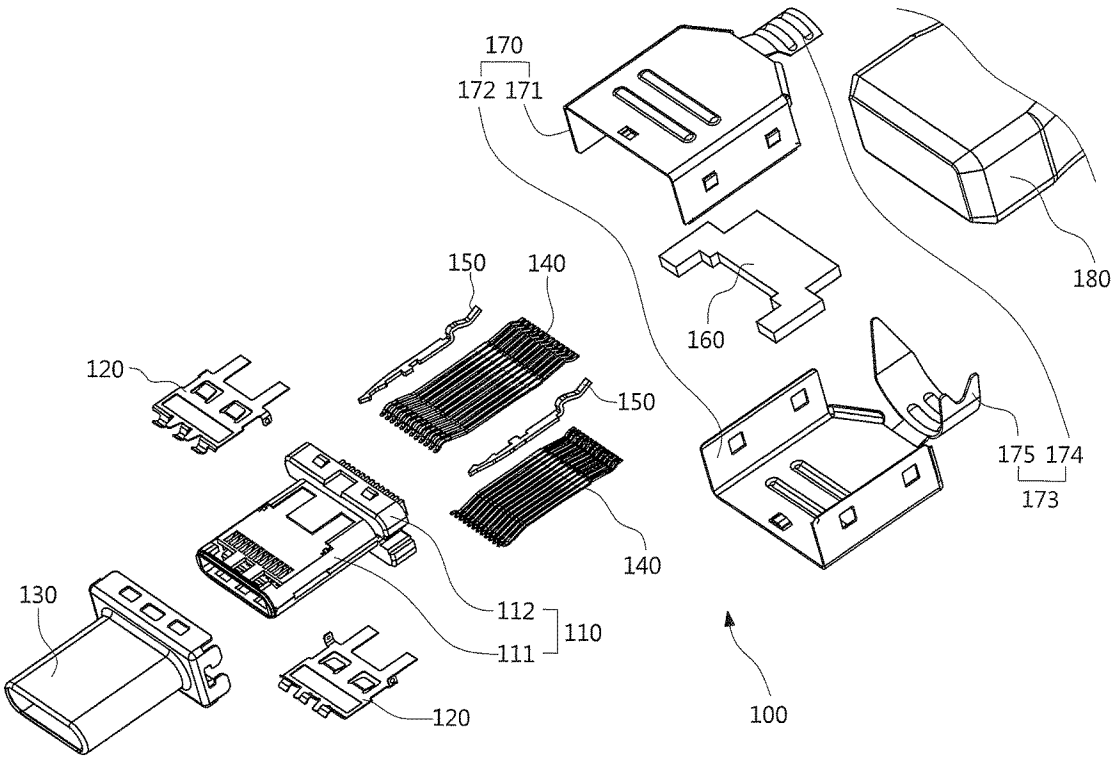
FIG. 2 is an exploded diagram of a preferred embodiment of the electrical plug connector according to the present invention.

Please refer to FIGS. 1 and 2. FIG. 1 is a schematic diagram of a preferred embodiment of an electrical plug connector according to the present invention. FIG. 2 is an exploded diagram of a preferred embodiment of the electrical plug connector according to the present invention. The electrical plug connector 100 can be an Universal Serial Bus (USB) Type C connector, which conforms, but is not limited, to the USB Type-C Cable and Connector Specification, Version 1.0 RC4. The electrical plug connector 100 comprises an insulated housing 110, two metallic plates 120, a metallic shell 130, a plurality of terminals 140, a pair of latches 150, a circuit board 160, an auxiliary metallic shell 170, an overcoat 180, and wires (not shown). The insulated housing 110 includes a front portion 111 and a rear portion 112. The front portion 111 extends forwardly from the rear portion 112, and an inside of the front portion 111 defines a receiving cavity 113. These two metallic plates 120 are separately engaged in the upper inner side and the lower inner side of the front portion 111 to enforce the mechanical strength of the insulated housing 110. The metallic shell 130 encloses the insulated housing 110, and the terminals 140 and the pair of latches 150 are retained in the lateral sides of the insulated housing 110. The terminals 140 are divided in two row terminal sets and are disposed in the insulated housing 110 by the two sides of the receiving cavity 113. The USB plug connector according to the present invention can have a 180 degree symmetrical, dual or double orientation design and pin assignments which enable the plug connector to be inserted into a corresponding receptacle connector in either of two intuitive orientations, i.e. in either upside-up or upside-down directions. In other words, the terminal sets are symmetrical about the central line of the receiving cavity 113 as the symmetrical center. The circuit board 160 is disposed in the rear of the rear portion 112, and is inserted between the upper-row terminals and the lower-row of the terminals. The front ends of the wires are soldered on the circuit board 160. The auxiliary metallic shell 170 surrounds the circuit board 160 and parts of the terminals 140 which are soldered on the circuit board 160. The overcoat 180 encloses the auxiliary metallic shell 170.

The cross-section of the rear portion 112 is greater than that of the front portion 111. The front portion 111 extends forwardly from the central portion of the rear portion 112. The metallic shell 130 has the shape corresponding to the insulated housing 110, and covers the front portion 111 and the rear portion 112. The rear end of the metallic shell 130 and the rear portion 112 are engaged with each other. The metallic shell 130 can be used to enforce the mechanical strength of the insulated housing 110. The auxiliary metallic shell 170 is formed by assembling an upper auxiliary metallic shell 171 and a lower auxiliary metallic shell 172. When the upper auxiliary metallic shell 171 and the lower auxiliary metallic shell 172 are assembled to each other, they are engaged with each other. The front end of the auxiliary metallic shell 170 grasps the rear end of the metallic shell 130. The rear end of the auxiliary metallic shell 170 includes a wire clamp portion 173. The wire clamping portion 173 is formed by connecting the upper wire clamping portion 174 of the upper auxiliary metallic shell 171 and the lower wire clamping portion 175 of the lower auxiliary metallic shell 172. The wire clamping portion 173 is used to clip the wire to keep the wires retained tightly. The overcoat 180 includes a pipe portion 181, and the pipe portion 181 is located in the rear end of the overcoat 180. The wires penetrate the pipe portion 181. The overcoat 180 can further protect the auxiliary metallic shell 170 and its interior parts, and the pipe portion 181 can protect the wires.

In the preferred embodiment, the rear end of the wires can be connected to an electrical device, and the front end of the electrical plug connector 100 is inserted into a mating electrical receptacle connector (not shown). The electrical receptacle connector is embedded inside an electrical device. That is to say, the electrical plug connector 100 can be used in two electrical devices to conduct the electrical connection. In the other embodiment, the electrical plug connector 100 can be replaced with a storage device with a plug, such as a USB flash drive which conforms to the USB type-C specifications. In this situation, the auxiliary metallic shell 170, the overcoat 180, and the wires can be omitted from the electrical plug connector, and memory can be disposed on the circuit board 160 instead. An appearance piece can be used to cover said plug electrical connector.

Figure 3:
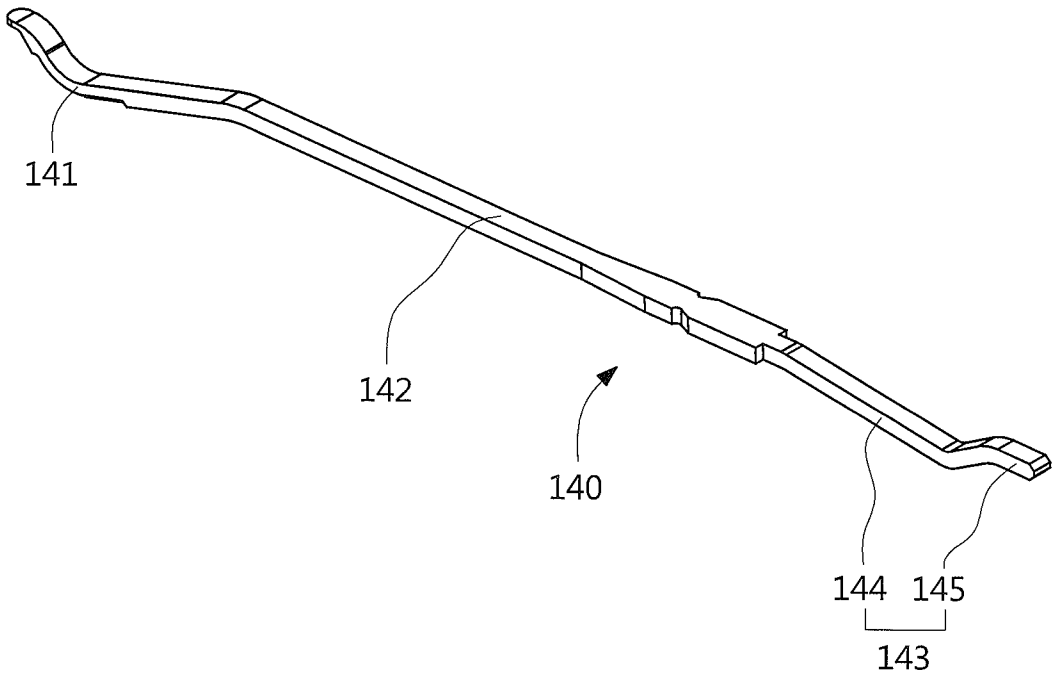
FIG. 3 is a schematic diagram of the terminals according to a preferred embodiment of the present invention.
Figure 4:
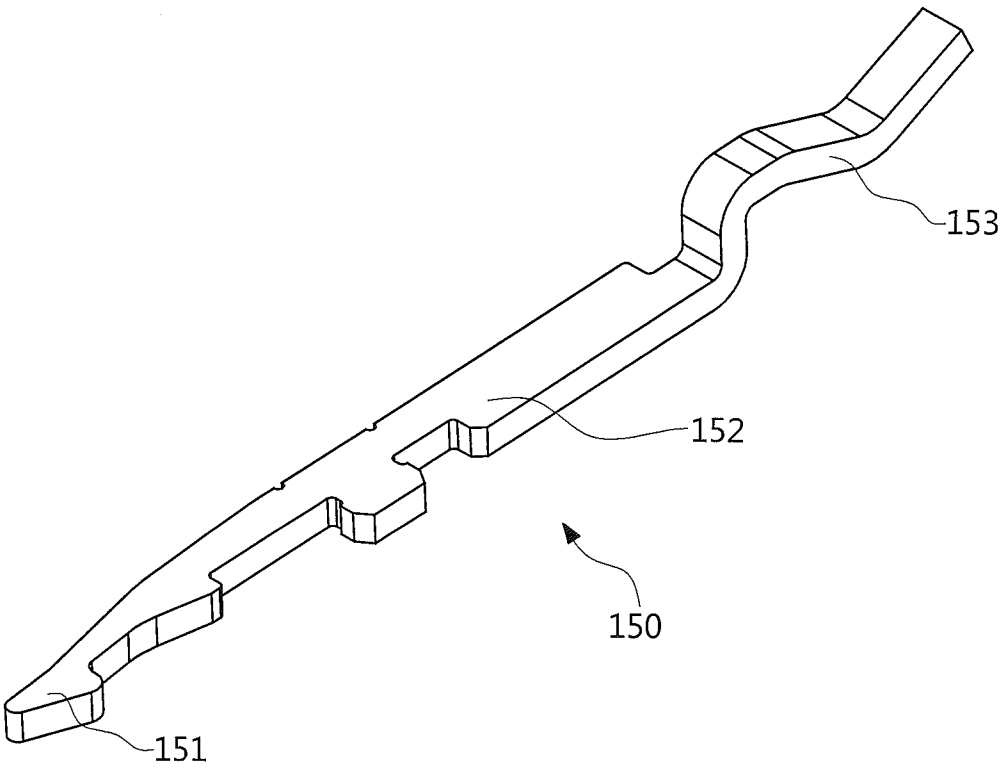
FIG. 4 is a schematic diagram of the latches according to a preferred embodiment of the present invention.

Please refer to FIGS. 3 and 4. FIG. 3 is a schematic diagram of the terminals according to a preferred embodiment of the present invention. FIG. 4 is a schematic diagram of the latches according to a preferred embodiment of the present invention. Each terminal 140 in this preferred embodiment includes a contact portion 141, a retaining portion 142, and a soldering portion 143. The contact portion 141 and the soldering portion 143 of each terminal 140 are of the spring arm type. Each latch 150 in the preferred embodiment includes a hook portion 151, a retaining portion 152, and a soldering portion 153, and the soldering portion 153 of each latch 150 is of the spring arm type.

Figure 5:
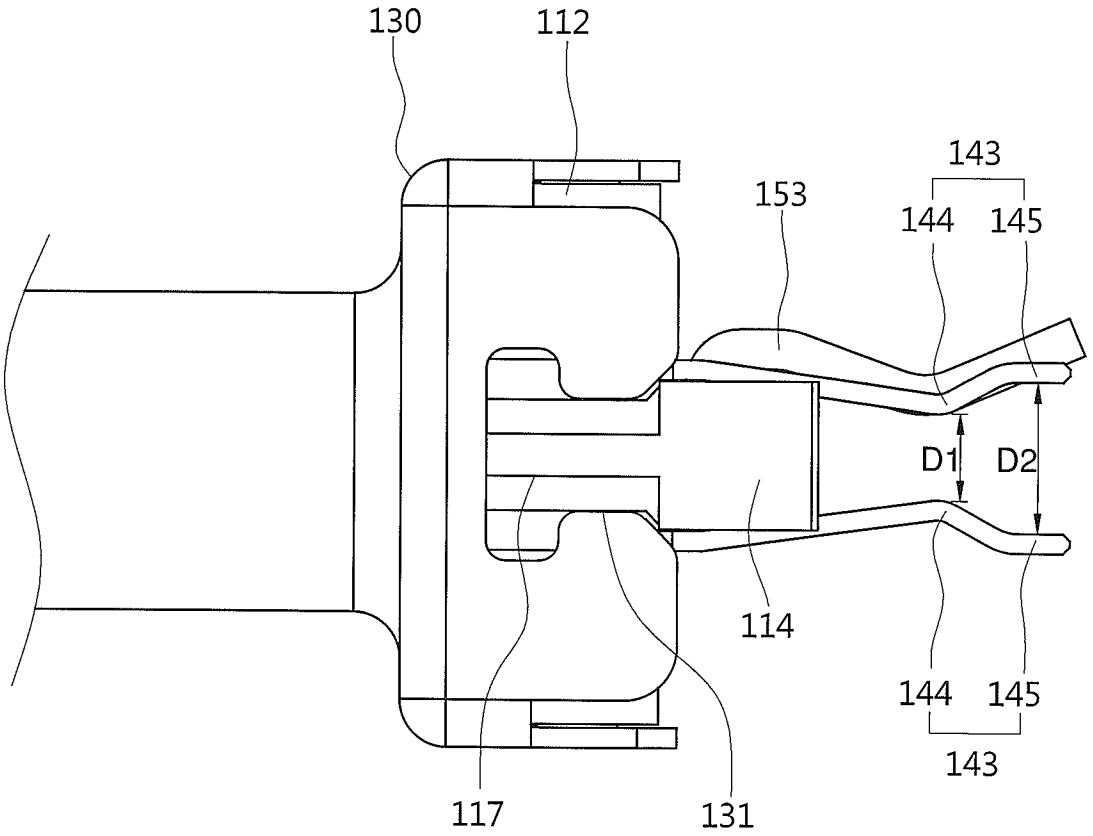
FIG. 5 is a side view of a preferred embodiment of the present invention of the electrical plug connector, in which the circuit board, the auxiliary metallic shell, and the protecting shell are omitted.
Figure 6:
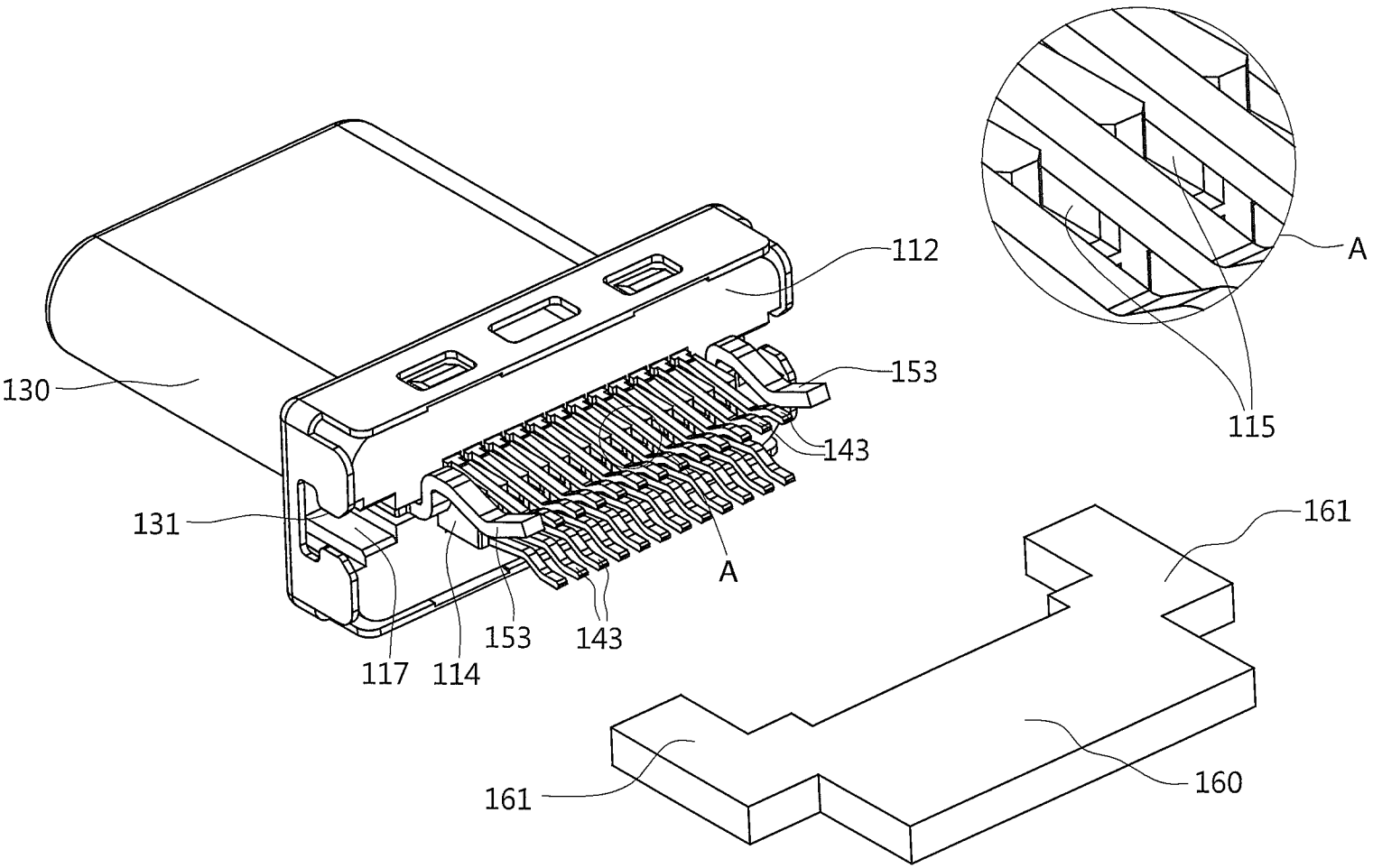
FIG. 6 is a schematic diagram of the circuit board and the soldering portions of the terminals before soldering according to a preferred embodiment of the present invention.

Please refer to FIGS. 1-6 together again. FIG. 5 is a side view of a preferred embodiment of the present invention of the plug electrical connector 100, in which the circuit board 160, the auxiliary metallic shell 170, and the overcoat 180 are omitted, and in which one latch 150 in front of the figure is also omitted to avoid blocking the upper row of the terminals 140 in FIG. 5. FIG. 6 is a schematic diagram of the circuit board 160 and the soldering portions 143 of the terminals 140 before soldering according to a preferred embodiment of the present invention. The A circle is an enlarged partial view of FIG. 6. The retaining portion 142 of the terminal 140 is retained in the insulated housing 110, and the contact portion 141 will be located in the receiving cavity 113. The soldering portion 143 extends backwardly from the retaining portion 142, and is disposed in the rear portion 112. The soldering portions 143 are arranged in symmetry as Ran an upper row and a lower row. As shown in FIG. 6, the insulated housing 110 in the preferred embodiment further includes a bump 114 which extends backwardly from the rear portion 112. A plurality of terminal slots 115 is disposed on the upper and lower inner sides of the bump 114. The parts of the soldering portion 143 of the terminals 140 are respectively located in the corresponding terminal slot 115. As shown in FIGS. 3 and 5, the soldering portion 143 includes a bending portion 144 and an end portion 145. The bending portion 144 and the end portion 145 extend out the rear portion 112. The end portion 145 extends backwardly from the bending portion 144. The shortest distance between the upper row and the lower row of the bending portions 144 is a first pitch D1. The shortest distance between the upper row and the lower row of the end portions 145 is a second pitch D2. The second pitch D2 is greater than the first pitch D1. The retaining portions 152 of these latches are separately retained in the lateral sides of the insulated housing 110. These two hook portions 151 will extend to the receiving cavity 113, as shown in FIG. 6. The soldering portions 153 of these two latches 150 extend backwardly out the rear portion 112, and are arranged at two sides of the soldering portion 143 of the upper row of the terminals 140.

Figure 7:
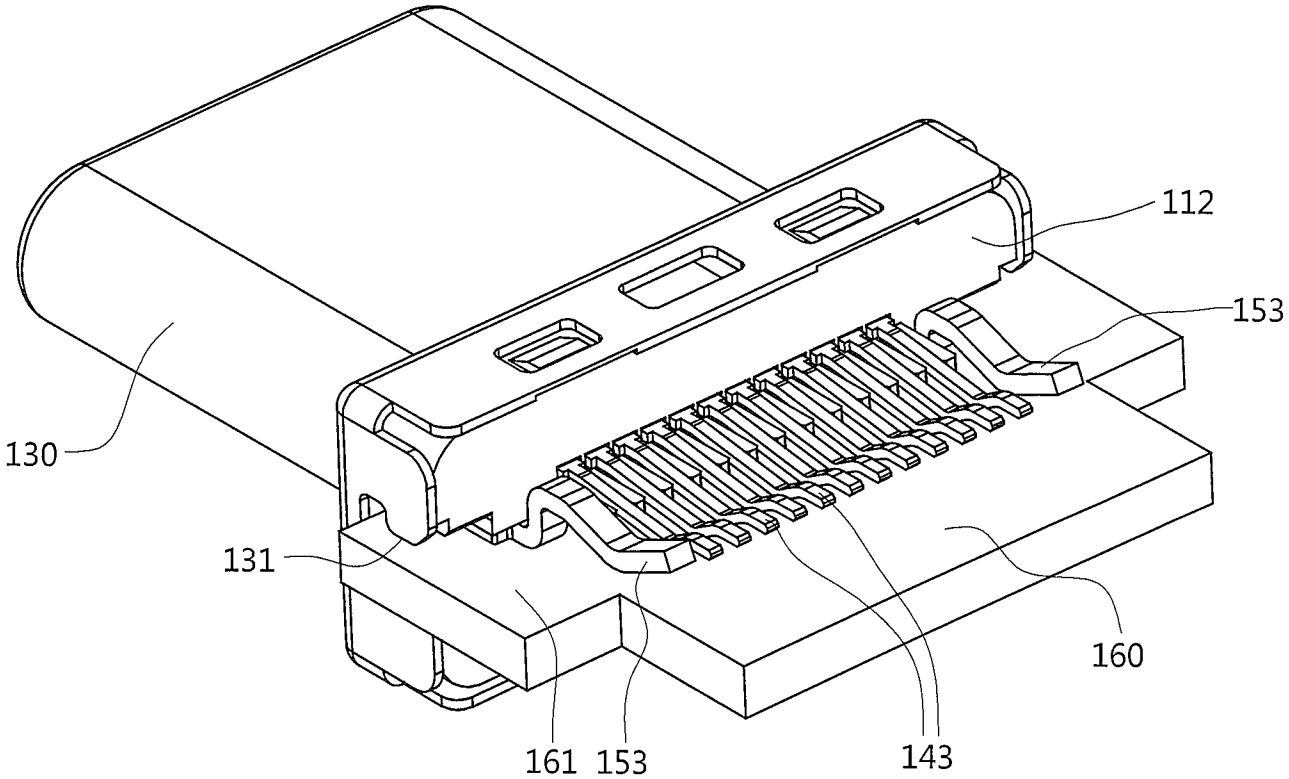
FIG. 7 is a schematic diagram of the circuit board and the soldering portions of the terminals after soldering according to a preferred embodiment of the present invention.

Please refer to FIGS. 5-7 together. FIG. 7 is a schematic diagram showing that the soldering portions of the terminals are soldered on the circuit board according to a preferred embodiment of the present invention. During the process, the circuit board 160 is inserted between the upper-row and lower-row soldering portion 143. The upper row and lower row of the soldering portion 143 clip elastically the circuit board 160. The second pitch D2 is greater than the first pitch D1, such that the effect of guiding and positioning the circuit board 160 between the upper row and lower row of the soldering portion 143 is obtained. When the circuit board 160 is inserted between the upper-row and lower-row end portion 145, the circuit board 160 will not collide with the soldering portion 143, because the second pitch D2 is greater (i.e. can accommodate the thickness of the circuit board 160 and still have some margin). The circuit board 160 is guided and can finally be clipped elastically by the upper-row and lower-row bending portions 144, as shown in FIG. 7, with the circuit board 160 being gradually inserted into the circuit board 160. Besides, with the circuit board 160 being clipped elastically by the upper-row and lower-row bending portions 144, the bending portions 144 will continue to apply a certain pressure (from the elastically recovering force from the soldering portions 143) on the corresponding contact points (not shown) and the solder pad of the circuit board 160. Therefore, the bending portion 144 can be further soldered on the circuit board 160 by the SMT technology. Compared to the conventional thermoforming technology of soldering the plate terminals onto the circuit board 160, the present invention can apply the SMT technology to solder to avoid possible loose soldering and short circuit caused by the solder-leaking when using the thermoforming technology. Besides, the soldering portion 153 of the latch 150 is also of the spring arm type, and the soldering portion 153 of the latch 150 will also press on the corresponding point and its solder pad of circuit board 160. Therefore, the soldering portion 153 of the latch 150 can also be soldered on the circuit board 160 by the SMT technology. The latches 150 can be used as grounding.

As shown in FIGS. 6 and 7, the circuit board 160 of this embodiment further comprises two wing portions 161. These two wing portions 161 are separately located at two sides of the circuit board 160. The insulated housing 110 further includes two recessed slots 117. These two recessed slots 117 are separately formed at two sides of the rear portion 112. The metallic shell 130 further includes two gaps 131. These two gaps 131 are disposed separately with respect to these two recessed slots 117. The wing portion 161 is inserted between the recessed slot 117 and the gap 131. These two wing portions 161 clip two sides of the rear portion 112. The wing portion 161, the recessed slot 117, and the gap 131 work in coordination to fix and orientate the circuit board 160 to let the bending portion 144 of the soldering portion 143 of each terminal 140 just press on the corresponding point of the circuit board 160.

Figure 8:
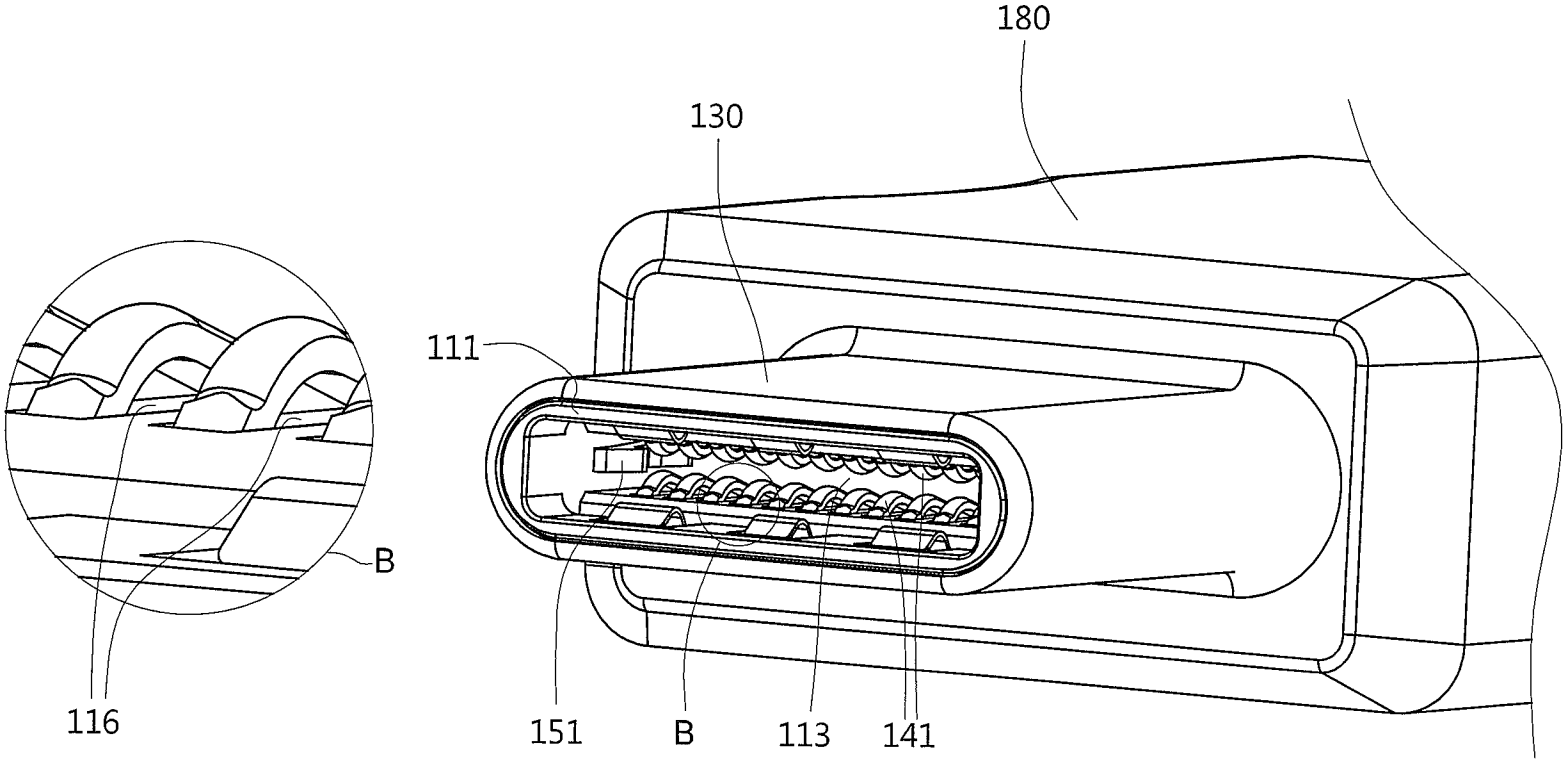
FIG. 8 is a schematic diagram of the terminals and the latches in the receiving cavity according to a preferred embodiment of the present invention.

Please refer to FIG. 8. FIG. 8 is a schematic diagram of the terminals and the latches disposed in the receiving cavity according to a preferred embodiment of the present invention. The B circle in FIG. 8 is a partially enlarged view. The inside of the front portion 111 includes an upper inner side, a left inner side, a lower inner side, and a right inner side (unnumbered). The receiving cavity 113 surrounds the upper inner side, the left inner side, the lower inner side, and the right inner side. The recesses of the upper inner side and the lower inner side are disposed with a plurality of terminal slots 115, 116. Notice that, although FIG. 8 shows only the terminal slots 115, 116 of the lower inner side, the terminal slots 115, 116 of the upper inner side are disposed symmetrically to that of the lower inner side, therefore not redundantly recited here. The terminals 140 of these two terminal sets are separately disposed on the upper inner side and the lower inner side. A part of the contact portion 141 is located in the terminal slot 115, 116, and the other part of the contact portion 141 projects from the terminal slot 115, 116 and extends forwardly of the receiving cavity 113. The contact portions 141 are arranged in symmetry as the upper row and the lower row in the receiving cavity 113, and the upper row and the lower row of the contact portions 141 can be inserted with the circuit board 160 of the mating electrical plug connector 100. When the electrical plug connector of the embodiment is inserted into the electrical receptacle connector, the circuit board 160 of the electrical receptacle connector will be inserted between the upper-row and the lower-row contact portion 141. With the contact portions 141 of the spring arm type, the upper-row and lower-row contact portion 141 not only have the good effect of guiding the insertion, but also clip elastically the circuit board 160 of the electrical receptacle connector to achieve the good effect of electrical conductivity. The hook portions 151 of the latches 150 extend toward the receiving cavity 113, and adjoin the left inner side and the right inner side of the receiving cavity 113. Although FIG. 8 shows only the hook portions 151 of the left inner side, the hook portions 151 of the right inner side are disposed in symmetrical to that of the left inner side, therefore not redundantly recited here. The hook portions 151 of the latches 150 also have good elasticity. When the circuit board 160 of the socket electrical connector is inserted into the receiving cavity 113, these two hook portions 151 will clip elastically the circuit board 160 of the electrical plug connector 100 to achieve the stable connection.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An electrical plug connector comprising:

an insulated housing including a front portion, a rear portion, and first and second recessed slots, wherein the front portion extends forwardly from the rear portion, wherein a receiving cavity is formed inside the front portion, wherein the front portion includes an upper inner side, a left inner side, a lower inner side, and a right inner side, wherein the upper inner side and the lower inner side respectively define a plurality of terminal slots, wherein the first and second recessed slots are separately disposed on two sides of the rear portion;

a metallic shell covering the insulated housing, wherein the metallic shell includes first and second gaps, wherein the first and second gaps are disposed separately with respect to the first and second recessed slots, with the first recessed slot intermediate the first gap and the second recessed slot and with the second recessed slot intermediate the first recessed slot and the second gap;

two terminal sets which respectively comprise a plurality of terminals, wherein the two terminal sets are disposed respectively on the upper inner side and the lower inner side, wherein each terminal includes a contact portion, a retaining portion, and a soldering portion, wherein the retaining portions of the plurality of terminals are retained in the insulated housing, the soldering portions of the plurality of terminals extend backwardly from the retaining portions and are disposed at the rear portion, wherein the soldering portions of the plurality of terminals are of a spring arm type and are arranged as an upper row and a lower row, wherein some parts of the contact portions of the plurality of terminals are disposed in the terminal slots, wherein other parts of the contact portions project from the plurality of terminal slots into the receiving cavity; and a circuit board inserted and elastically clipped between the upper-row soldering portions and the lower-row soldering portions, wherein the circuit board is inserted into the first and second recessed slots and the first and second gaps with the circuit board extending across from the first gap to the first recessed slot and extending across from the second gap to the second recessed slot to fix and orient the circuit board with the upper-row soldering portions and the lower-row soldering portions clipping elastically the circuit board.

2. The plug electrical connector of claim 1, wherein each soldering portion includes a bending portion and an end portion, wherein the bending portion extends backwardly from the rear portion, wherein the end portion extends backwardly from the bending portion, wherein the first and second recessed slots and the first and second gaps fix and orient the circuit board with the bending portions of the upper-row soldering portions and the lower-row soldering portions clipping elastically the circuit board, wherein a shortest distance between the upper-row bending portions and the lower-row bending portions is a first pitch, wherein a shortest distance between the upper-row end portions and the lower-row end portions is a second pitch, and wherein the second pitch is greater than the first pitch.

3. The electrical plug connector of claim 2, wherein the bending portions of the soldering portions are soldered on the circuit board by SMT technology.

4. The electrical plug connector of claim 1, wherein the contact portions are of a spring arm type.

5. The electrical plug connector of claim 1, wherein a cross-section of the rear portion is greater than that of the front portion, the front portion extends forwardly from a central portion of the rear portion, the metallic shell covers the front portion and the rear portion, and the rear end of the metallic shell and the rear portion are engaged with each other.

6. The electrical plug connector of claim 1, further comprising a wire and an auxiliary metallic shell, wherein the auxiliary metallic shell comprises a wire clamping portion disposed in a rear end of the auxiliary metallic shell, wherein a front end of the wire is soldered on the circuit board, wherein the auxiliary metallic shell surrounds the soldering portion of each terminal and the circuit board, wherein the wire clamping portion clamps the wire, and wherein a front end of the auxiliary metallic shell is engaged in a rear end of the metallic shell.

7. The electrical plug connector of claim 6, further comprising an overcoat which comprises a pipe portion disposed in a rear end of the overcoat and surrounds the auxiliary metallic shell.

8. The electrical plug connector of claim 1, wherein the two terminal sets are symmetrical to each other about a center line of the receiving cavity as a symmetrical center.

9. An electrical plug connector comprising:

an insulated housing including a front portion and a rear portion, wherein the front portion extends forwardly from the rear portion, wherein a receiving cavity is formed inside the front portion, wherein the front portion includes an upper inner side, a left inner side, a lower inner side, and a right inner side and the upper inner side and the lower inner side respectively define a plurality of terminal slots;

two latches, wherein each latch includes a hook portion, a retaining portion, and a soldering portion, wherein the retaining portions of the two latches are separately retained in the insulated housing, wherein the hook portions of the two latches project into the receiving cavity and adjoin the left inner side and the right inner side, wherein the soldering portions of the two latches extend backwardly out the rear portion and bends upwardly, then bends backwardly and obliquely downwardly, and then bends obliquely upwardly;

a metallic shell covering the insulated housing;

two terminal sets which respectively comprise a plurality of terminals, wherein the two terminal sets are disposed respectively on the upper inner side and the lower inner side, wherein each terminal includes a contact portion, a retaining portion, and a soldering portion, wherein the retaining portions of the plurality of terminals are retained in the insulated housing, the soldering portions of the plurality of terminals extend backwardly from the retaining portions and are disposed at the rear portion, wherein the soldering portions of the plurality of terminals are of a spring arm type and are arranged as an upper row and a lower row, wherein some parts of the contact portions of the plurality of terminals are disposed in the terminal slots, wherein other parts of the contact portions project from the plurality of terminal slots into the receiving cavity; and a circuit board inserted between the upper-row soldering portions and the lower-row soldering portions, wherein the upper-row soldering portions and the lower-row soldering portions clip elastically the circuit board, and wherein the soldering portions of the two latches are of a spring arm type and are soldered on the circuit board.

10. The electrical plug connector of claim 9, wherein the two terminal sets are symmetrical to each other about a center line of the receiving cavity as a symmetrical center.

11. An electrical plug connector comprising:

an insulated housing including a front portion and a rear portion, wherein the front portion extends forwardly from the rear portion, wherein a receiving cavity is formed inside the front portion, wherein the front portion includes an upper inner side, a left inner side, a lower inner side, and a right inner side, and wherein the upper inner side and the lower inner side respectively define a plurality of terminal slots;

a metallic shell covering the insulating housing;

two terminal sets which respectively comprise a plurality of terminals, wherein the two terminal sets are symmetrical to each other about a center line of the receiving cavity as a symmetrical center, wherein the terminal sets are disposed respectively on the upper inner side and the lower inner side, wherein each terminal includes a contact portion, a retaining portion, and a soldering portion, wherein the retaining portions of the plurality of terminals are retained in the insulated housing, wherein the soldering portions of the plurality of terminals extend backwardly from the retaining portions and are disposed at the rear portion, wherein the soldering portions of the plurality of terminals are of a spring arm type and are arranged as an upper row and a lower row, wherein some parts of the contact portions of the plurality of terminals are disposed in the plurality of terminal slots, wherein other parts of the contact portions project from the plurality of terminal slots into the receiving cavity; and a circuit board inserted between the upper-row soldering portions and the lower-row soldering portions, wherein the upper-row soldering portions and the lower-row soldering portions clip elastically the circuit board, wherein the circuit board includes two wing portions, wherein the two wing portions are separately disposed on two sides of the circuit board, wherein the insulated housing further includes two recessed slots, wherein the two recessed slots are separately disposed on two sides of the rear portion, wherein the metallic shell includes two gaps, wherein the two gaps are disposed separately with respect to the two recessed slots, wherein the two wing portions are inserted between the two recessed slots and the two gaps, and wherein the two wing portions are clipped at two sides of the rear portion.

* * * * *